US010781558B2

(12) United States Patent
Sánchez Jorrín

(10) Patent No.: US 10,781,558 B2
(45) Date of Patent: Sep. 22, 2020

(54) OPERATING AND LOCKING MECHANISM FOR TURNOUTS OF CENTRAL RAIL-GUIDED VEHICLES

(71) Applicants: JEZ SISTEMAS FERROVIARIOS, S.L., Llodio Álava (ES); VOESTALPINE VAE GMBH, Vienna, Österreich (AT)

(72) Inventor: Juan Carlos Sánchez Jorrín, Llodio Álava (ES)

(73) Assignees: JEZ SISTEMAS FERROVIARIOS, S.L., Liodio Álava (ES); VOESTALPINE VAE GMBH, Vienna, Österreich (AT)

( * ) Notice: Subject to any disclaimer, the term of this patent is extended or adjusted under 35 U.S.C. 154(b) by 290 days.

(21) Appl. No.: 15/579,691

(22) PCT Filed: Jun. 3, 2016

(86) PCT No.: PCT/ES2016/070415

§ 371 (c)(1),
(2) Date: Dec. 5, 2017

(87) PCT Pub. No.: WO2016/193522

PCT Pub. Date: Dec. 8, 2016

(65) Prior Publication Data

US 2018/0163347 A1 Jun. 14, 2018

(30) Foreign Application Priority Data

Jun. 5, 2015 (EP) ..... 15382294

(51) Int. Cl.
*E01B 25/28* (2006.01)
*B61L 5/10* (2006.01)

(52) U.S. Cl.
CPC ..... *E01B 25/28* (2013.01); *B61L 5/10* (2013.01)

(58) Field of Classification Search
CPC ..... E01B 7/00; E01B 7/02; E01B 7/10; E01B 7/12; E01B 7/14; E01B 7/16; E01B 7/18;
(Continued)

(56) References Cited

U.S. PATENT DOCUMENTS 1,956,021 A * 4/1934 Goodaire ..... E01B 7/28 246/460
8,051,777 B2 * 11/2011 Weissbrodt ..... B61J 1/02 104/102

(Continued)

FOREIGN PATENT DOCUMENTS

FR 2755982 A1 5/1998
FR 2850983 A1 8/2004
WO 2008009829 A2 1/2008

OTHER PUBLICATIONS

International Search Report for corresponding application PCT/ES2016/070415 filed Jun. 3, 2016; dated Aug. 19, 2016.

(Continued)

*Primary Examiner* — Jason C Smith
(74) *Attorney, Agent, or Firm* — Cantor Colburn LLP

(57) ABSTRACT

An operating and locking mechanism for turnouts of central rail-guided vehicles, where the mechanism at the entrance of the turnout includes: a guide block fixed to a fixed part comprising having two guide grooves, two shafts fixed to a moving panel, a moving rocking lever which pivots around a shaft attached to the fixed element and centered with respect to the guide block and perpendicular to the main plane thereof, where the rocking lever includes grooves located on the main plane of the rocking lever within which rollers which are at a higher level with respect to the rollers of the shafts can be moved and rolled, and where the mechanism at the exit of the turnout includes: a guide block fixed to the fixed part having two guide grooves, two shafts fixed to the moving panel, a moving rocking lever which pivots around a shaft attached to the fixed element and centered with respect to the guide block and perpendicular to the main plane thereof, where the rocking lever comprises grooves located on the main plane of the rocking lever within which rollers which are at a higher level Z with (Continued)

respect to the rollers of the shafts can be moved and rolled, where the rocking levers move in a synchronous manner and in the same direction by means of rods of the drive motor, generating a rotation of the moving panel around the pivoting point such that the shafts simultaneously reach their locking positions through either the direct route or the diverted route.

4 Claims, 13 Drawing Sheets

(58) Field of Classification Search
CPC ... E01B 7/28; E01B 7/30; E01B 25/25; B61L 5/10
See application file for complete search history.

(56) References Cited

U.S. PATENT DOCUMENTS

| | | | | |
|---|---|---|---|---|
| 2014/0190366 | A1 | 7/2014 | Mukai | |
| 2015/0107483 | A1* | 4/2015 | Consoli | B62D 1/265 104/242 |
| 2016/0083912 | A1* | 3/2016 | Andre | E01B 7/28 246/381 |
| 2018/0163347 | A1* | 6/2018 | Sánchez Jorrín | E01B 25/28 |

OTHER PUBLICATIONS

Written Opinion for corresponding application PCT/ES2016/070415 filed Jun. 3, 2016; dated Aug. 19, 2016.

* cited by examiner

OPERATING AND LOCKING MECHANISM FOR TURNOUTS OF CENTRAL RAIL-GUIDED VEHICLES

TECHNICAL FIELD OF THE INVENTION

The present invention relates to an operating and locking mechanism for turnouts of central rail-guided vehicles, applied in the industry of guided vehicles.

BACKGROUND OF THE INVENTION

A central rail-guided vehicle is a vehicle usually made up of a plurality of wagons and circulating on rubber tires, which bear the weight of the vehicle and provide it with the tractive and braking efforts required in traffic. The surface on which these vehicles circulate is generally urban streets but on exclusive roadways, similar to tramways.

A specially-shaped central rail is arranged embedded in the surface for guiding said vehicles. Two railway-type wheels assembled in one and the same truck or bogie in the vehicle such that their axles form an angle of about 90° are supported on said rail. The arrangement of said wheels and the special shape of the central rail are what guide the vehicle, such that said vehicle must follow the path marked by said central rail. For the guiding to be effective four trucks or bogies are arranged for each wagon of the vehicle, said trucks or bogies having a pivoting arrangement with respect to the body of the wagon similar to the wagons of a railway or tramway.

Like tramway or railway vehicles, these central guide systems have railway layouts such as turnouts, which allow the vehicle to alternatively choose between a main or straight path and a curved diverted path. Like the central rail, said turnouts are generally embedded in the surface.

Given that these systems are conceived for being installed in the urban layout, the radii of the curves in which the vehicles must be inscribed are generally smaller than the radii of the curves of common railway vehicles, as occurs in the case of tramways.

Similarly to tramway turnouts, turnouts of guided vehicles have smaller radii in the diverted track, in the order of 20-30 m, and even less. The fact that the central guide rail is simultaneously active on both sides of the head provides turnouts intended for central rail-guided vehicles with a different configuration with respect to the railway or even common tramway turnouts.

Patent document FR-2755982 describes a turnout for central rail-guided vehicles consisting of a pivoting moving panel at the heel end thereof on which both the rail of the direct route and the rail of the diverted route are assembled. By means of the rotation or operation of the moving panel, the rail of the direct route or the rail of the diverted route is alternatively and selectively connected with the fixed inbound rail or alternatively with one fixed rail or the other at the heel of the turnout, providing one of the mentioned routes with continuity.

The fact that it is necessary to keep a minimum separation distance between both rails assembled on the moving panel so that both guide wheels have enough free passage distance limits this type of construction. With a larger minimum distance between guide rails in the turnout, which is necessary for the passage of the guide wheels, the turning radius of the moving panel increases, the center of rotation of said panel even being located very far from the point of the turnout, which makes a considerably long turnout necessary. Furthermore, as a faster speed of passage through the diverted route is necessary, the value of the radius thereof must be increased, this being a factor that increases the length of the moving panel and therefore the total length of the turnout. Therefore, considering the foregoing, it is understood that the configuration described in patent document FR-2755982 is not advantageous from the design viewpoint given that it produces very long turnouts without providing any additional technical advantage or feature.

On the other hand, in the invention described in patent document FR-2850983 the pivoting movement of the panel on which the rails of the direct route and the diverted route are assembled is prevented by replacing said movement with a straight lateral movement of the panel in the direction perpendicular to the direct route, alternatively coupling the direct route or the diverted route by means of said movement. The technical drawback of patent document FR-2755982 as discussed above is thereby solved, allowing shorter turnout designs.

However, in the two cases described above the technical problem of the control system used for causing movement of the panel is not solved in a satisfactory manner. Nor is a locking system for fixing a secure end position of either the direct route or the diverted route described in any of the mentioned patent documents. These two aspects are important from a technical viewpoint.

Finally, it must be considered that in many central rail-guided systems it is common, for safety and maintenance reasons, for the system made up of the turnout, the drive motor and the locking system to be required to not invade the area of the surface intended for the rolling of the rubber tires of the vehicle.

DESCRIPTION OF THE INVENTION

The present invention relates to an operating and locking mechanism for turnouts of central rail-guided vehicles, which allows solving the problems of the state of the art in that it allows reducing the dimensions of turnouts and assuring a secure end position.

To that end, the mechanism proposed by the invention is defined in the independent claims. Advantageous embodiments of the invention are defined in the dependent claims.

The mechanism of the invention solves the problem with pivoting of the moving panel in turnouts in which the point of rotation of said moving panel is very far away from the point of the turnout, even though it can also be used in turnouts in which the pivoting point of the moving panel is close to the point of the turnout.

Another additional advantage of the mechanism of the invention is the locking functionality it incorporates, as it mechanically fixes the moving part of the turnout in its end positions, its involuntary or spontaneous movement as a result of the passage of traffic through any of the two routes of the turnout not being possible. Therefore, the mechanism object of the present invention adds an advantage from the safety viewpoint in turnout control, thus preventing possible accidents as a result of the turnout being in an incorrect intermediate position, which would cause the guide wheels to derail, which in turn can cause serious accidents.

The mechanism of the present invention is also very compact in construction, being able to be integrated with the drive motor within the casing or fixed part of the turnout, which ends up having restrained dimensions. As previously mentioned, it is a necessary requirement for the system formed by the turnout and its drive to not invade the area of the roadway intended for the rolling of the rubber tires of central rail-guided vehicles.

The operating and locking mechanism of the invention has a low life cycle cost. Furthermore, it is easily accessible for inspection, assembly, disassembly, element replacement and maintenance.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting manner.

PREFERRED EMBODIMENT OF THE INVENTION

Figure 1:
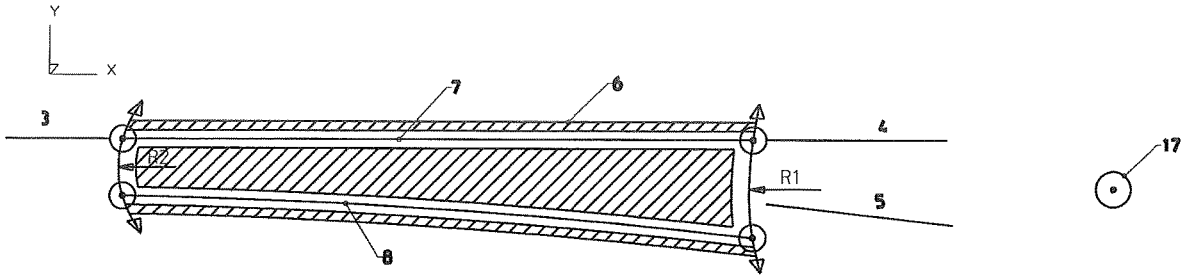
FIG. 1 shows a schematic plan view of the turnout of central rail-guided vehicles providing passage through its main route, the pivoting point of the moving panel being behind the fixed heel area.

An embodiment of the mechanism object of the invention is described in view of the mentioned drawings which depict a turnout with a straight main or direct route and a right-curved diverted route, such that this description of the invention is based on said geometric configuration. For a turnout with a left-curved diverted route it would be necessary to use view the mirror images of what is depicted, the descriptions of the invention being valid for this configuration.

The planes parallel to the XY plane defined in the drawings are defined therein as the main planes of the components. The plan views correspond to the direction perpendicular to the XY plane, and Z axis perpendicular to the XY plane, increasing heights corresponding to increasing values of Z.

Direction X is parallel to the main route of the turnout in the direction of increasing value towards the part defined as back of the turnout or heel.

According to a preferred embodiment of the operating and locking mechanism object of the present invention patent, the turnout comprises a fixed part or element (2), which can also be referred to as casing (2), where said fixed part (2) is prepared for being embedded in the surface of the street, the upper part of the turnout being flush with the surface.

In said casing (2) there are housed the main elements of the turnout as well as the drive motor, additionally serving as a support for the fixed inbound rail (3), and the fixed outbound rails of the main route (4) and of the diverted route (5). It is contemplated that the fixed element (2) comprises a plurality of removable protective covers (2C) bolted into the upper part thereof, flush with the roadway. Said protective covers (2C) protect a moving element (6) comprised in the operating and locking mechanism object of the invention, and allow access thereto to perform cleaning and maintenance tasks. It is contemplated that the fixed element (2) comprises water drainage conduits in the lower part thereof, not depicted in the drawings, and it can also house heating elements required for operating the turnout in the winter. According to a preferred embodiment, the fixed element (2) is made of steel built by mechanical welding and is protected against corrosion by means of treatments such as zinc coating or antioxidant priming.

Figure 2:
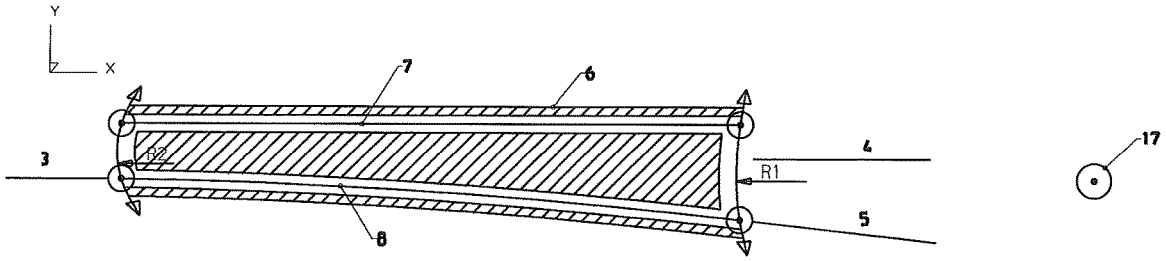
FIG. 2 shows a schematic plan view of the turnout depicted in FIG. 1 providing passage through its diverted route, the pivoting point of the moving panel likewise being behind the fixed heel area.
Figure 3:
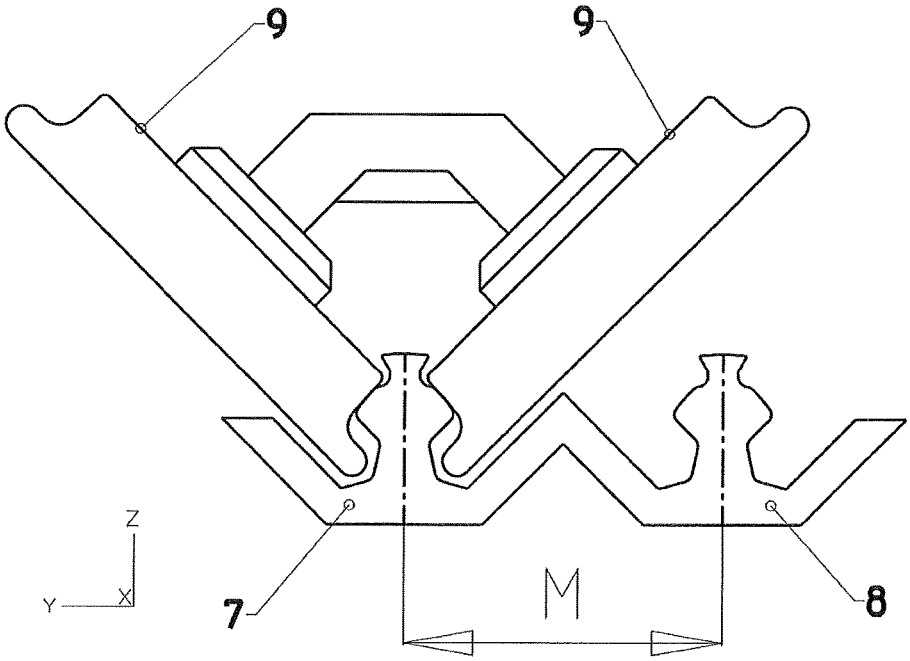
FIG. 3 shows a cross section of the guide rail of the main route of the turnout, two guide wheels travelling on the rail of the main route and next to it the rail of the diverted route having been depicted. For the sake of clarity the bogie has not been depicted.
Figure 4:
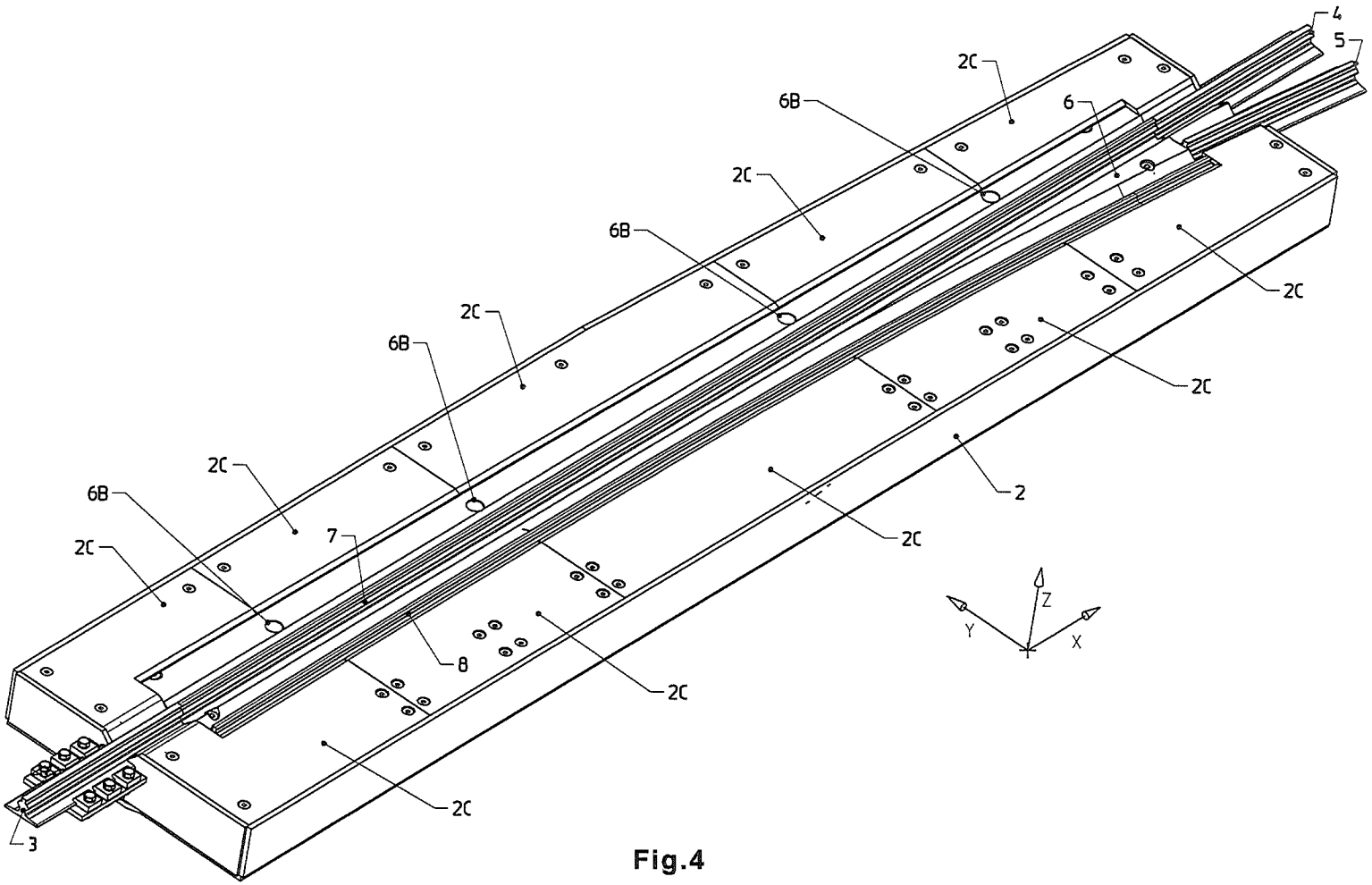
FIG. 4 shows a perspective view of the turnout of the invention providing passage through the main route.
Figure 5:
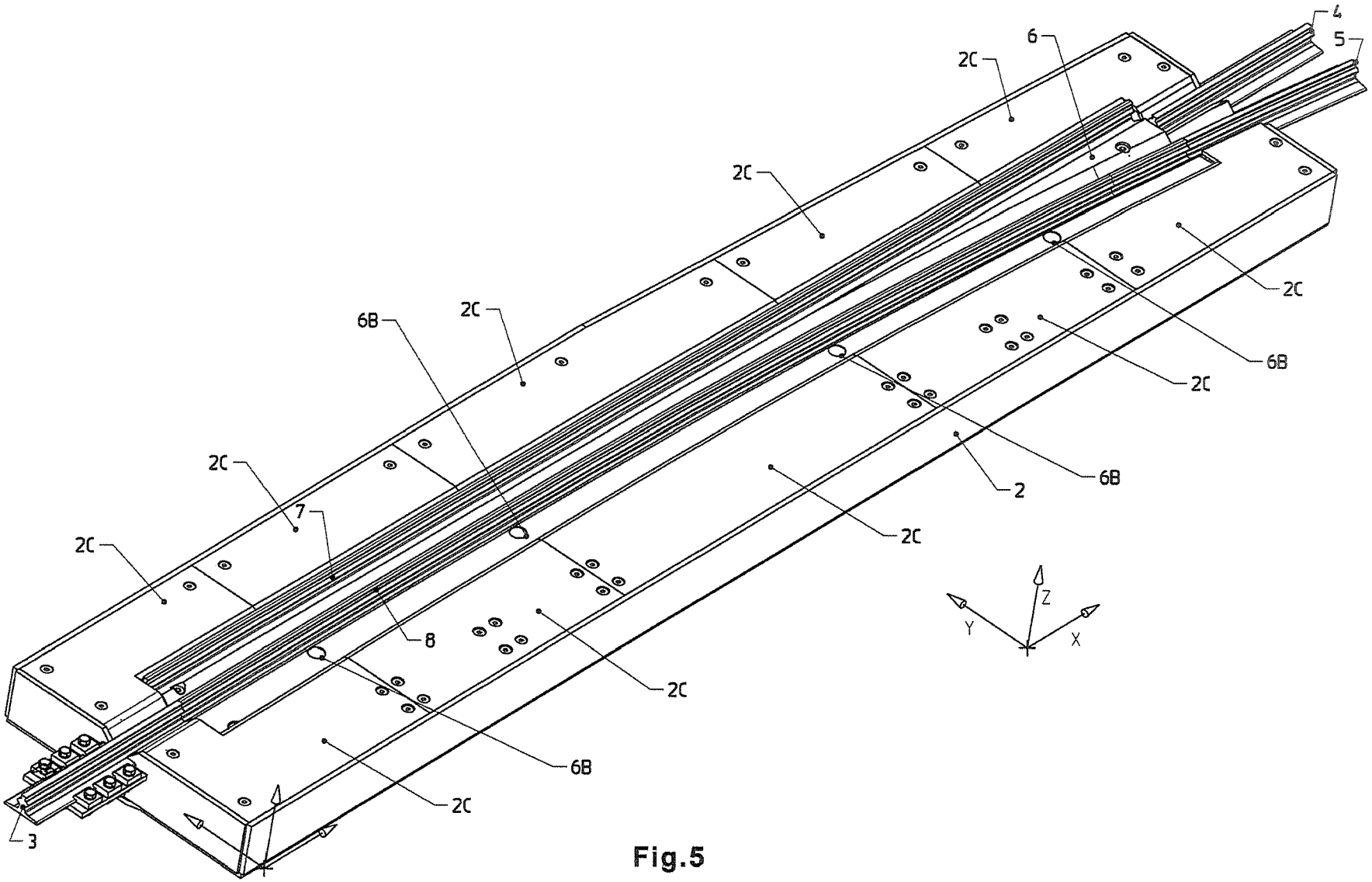
FIG. 5 shows a perspective view of the turnout like the one in FIG. 4 providing passage through the diverted route.
Figure 6:
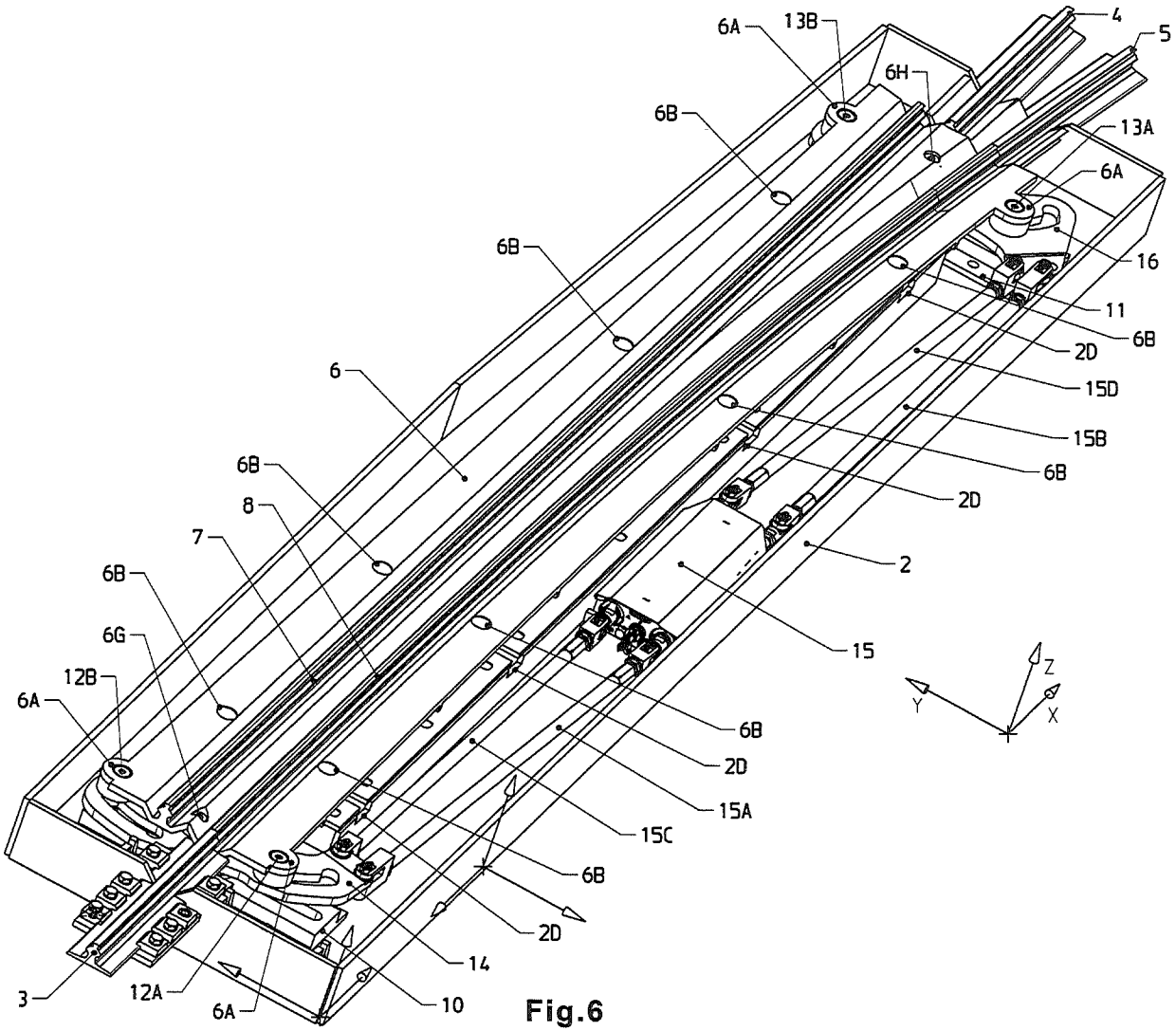
FIG. 6 shows a perspective view of the turnout depicted in FIGS. 4 and 5, in this case depicted without the protective covers and its supports.
Figure 7:
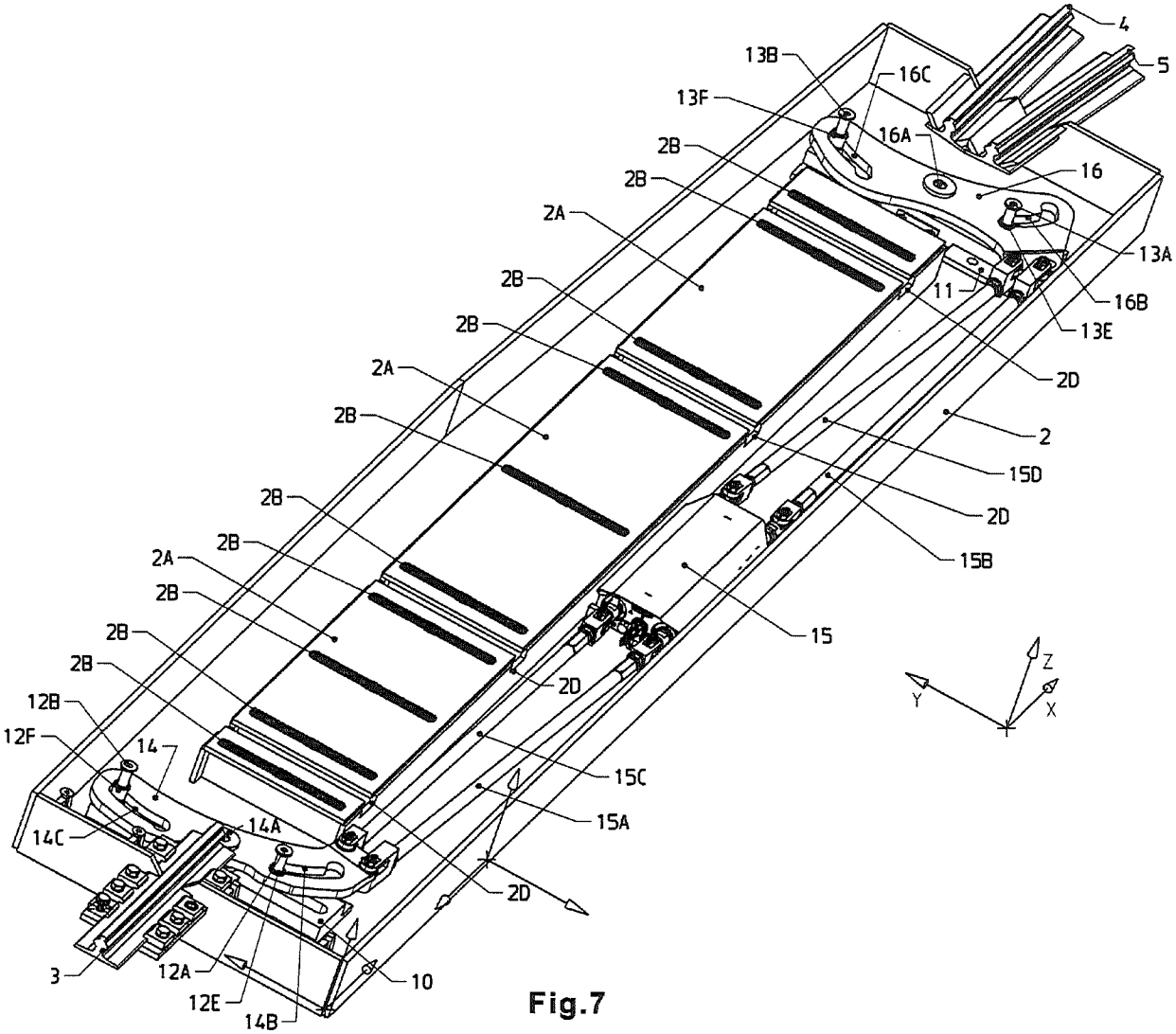
FIG. 7 shows a perspective view of the turnout like the one in FIG. 6, in this case depicted without the protective covers, its supports and without the moving element.
Figure 8:
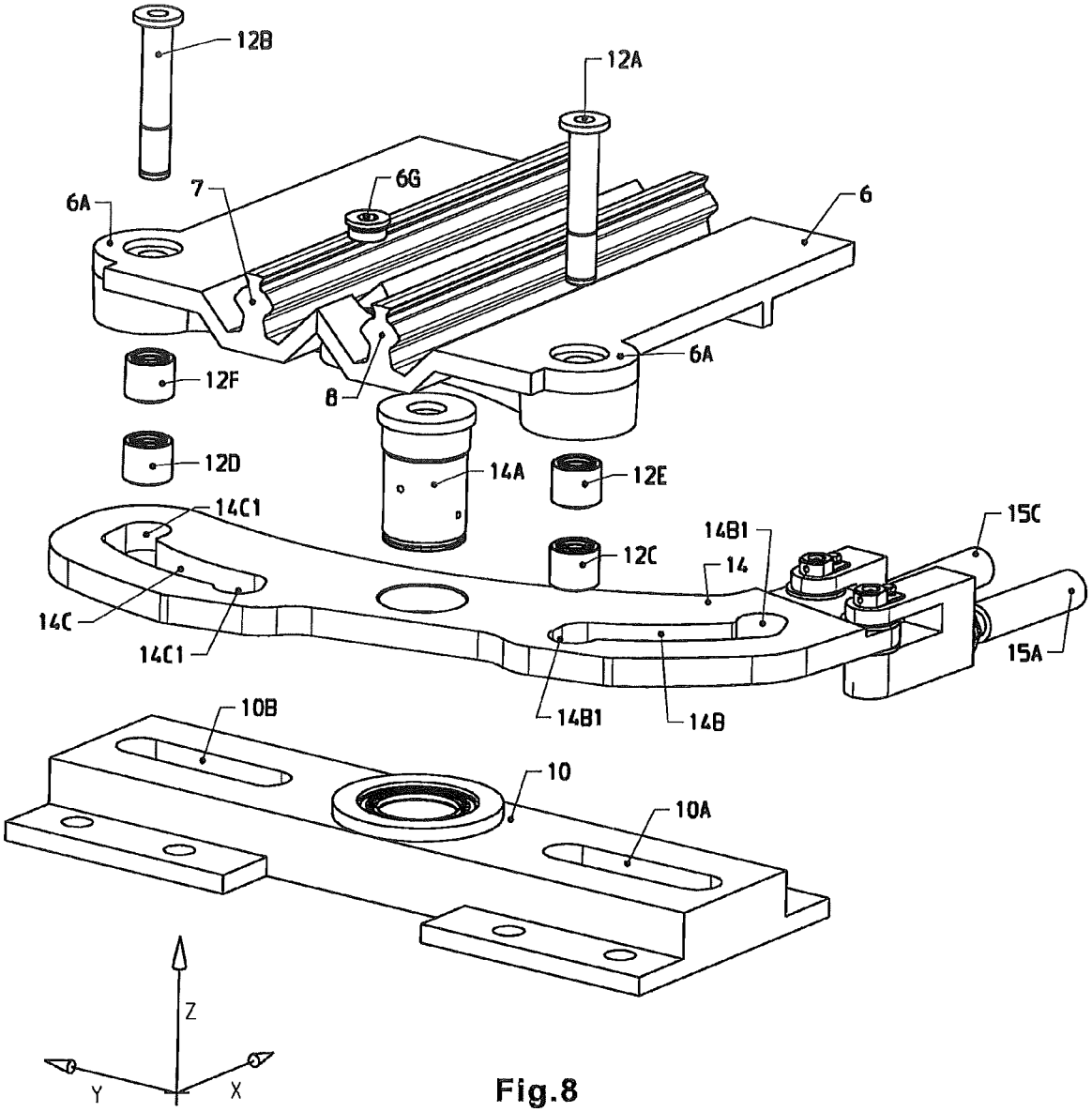
FIG. 8 shows an exploded view of the operating and locking mechanism at the entrance of the turnout.
Figure 9:
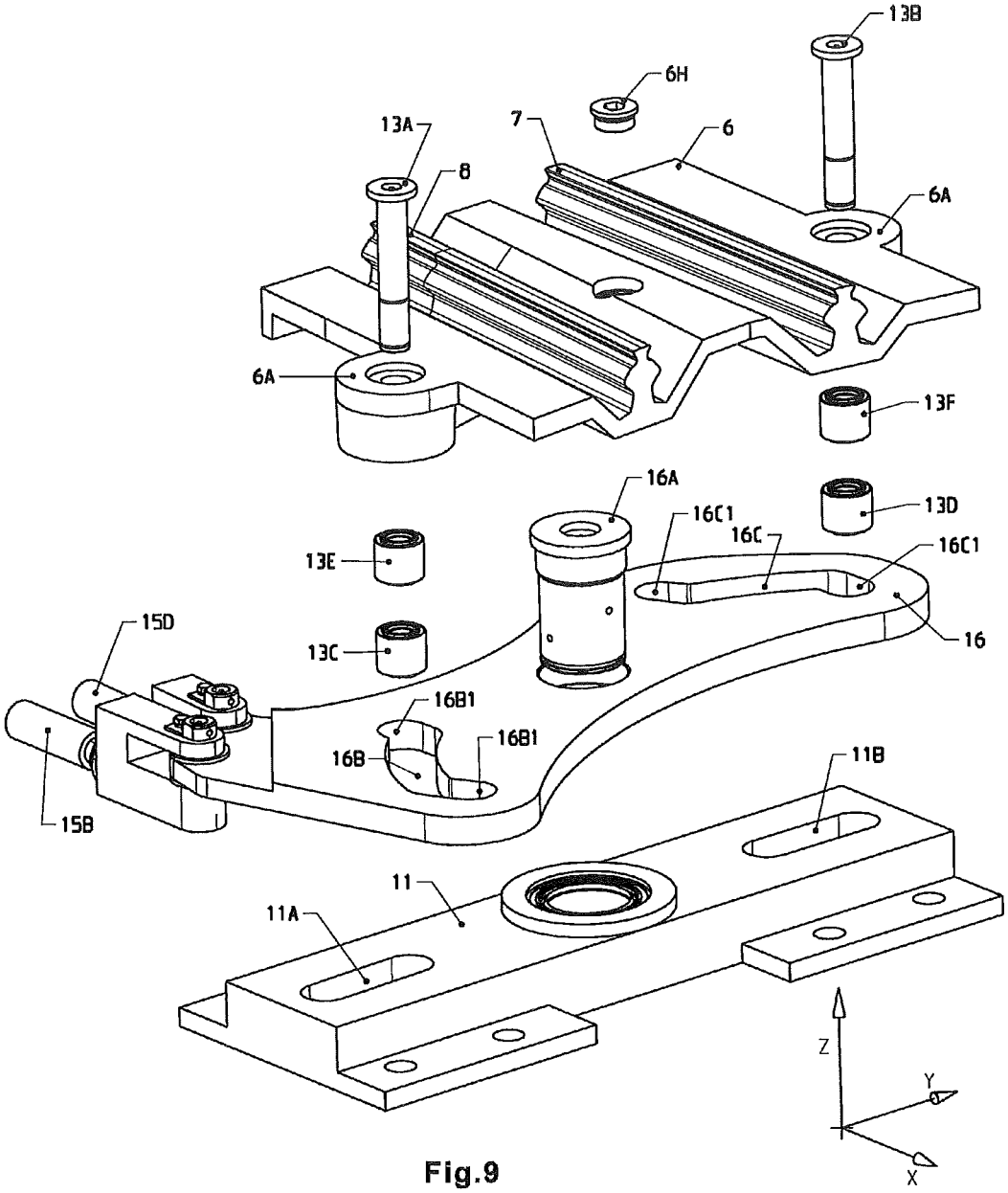
FIG. 9 shows an exploded view of the operating and locking mechanism at the exit of the turnout.
Figure 10:
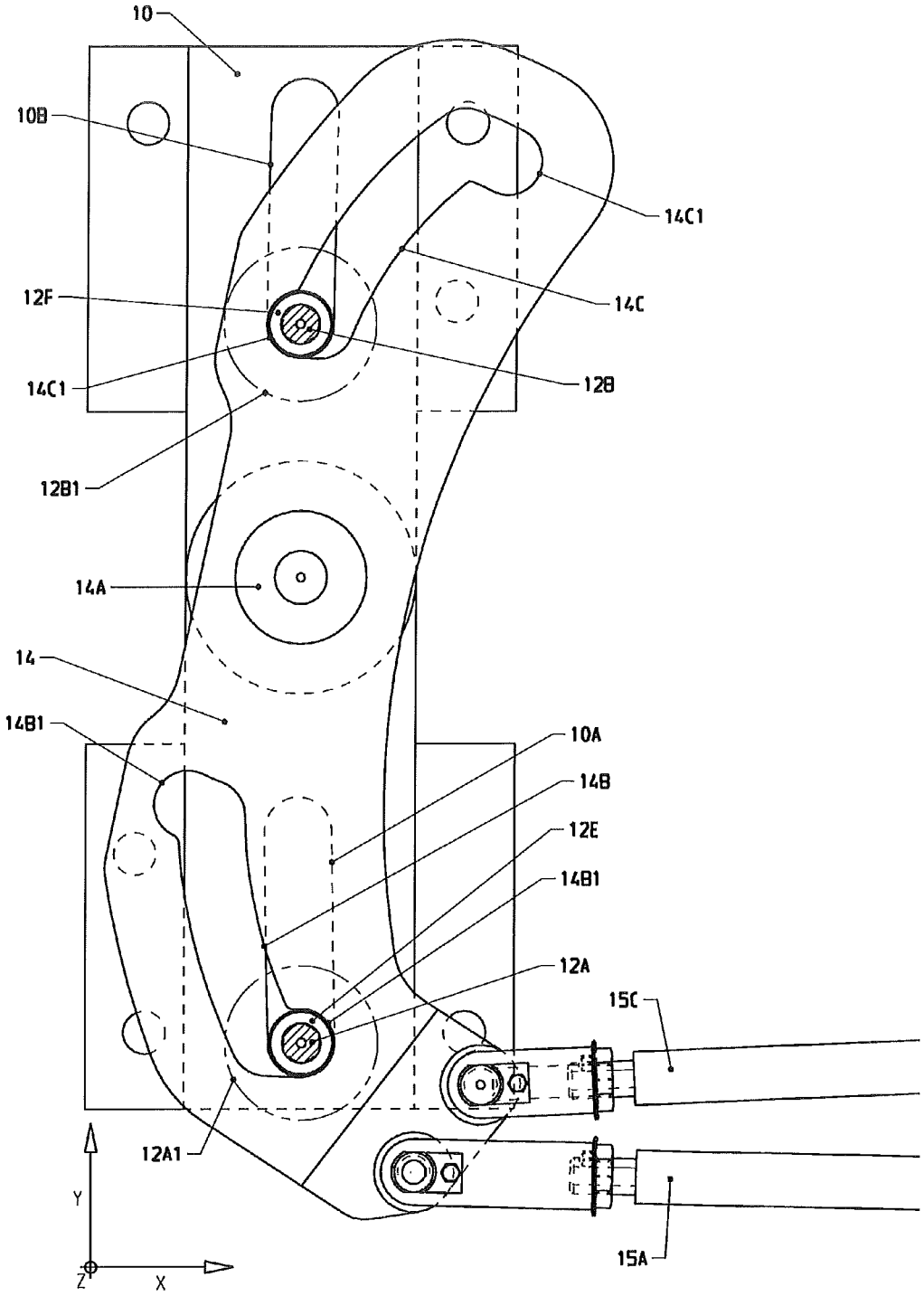
FIG. 10 shows a plan view of the operating and locking mechanism at the entrance of the turnout in its end position corresponding to the main or direct route.
Figure 11:
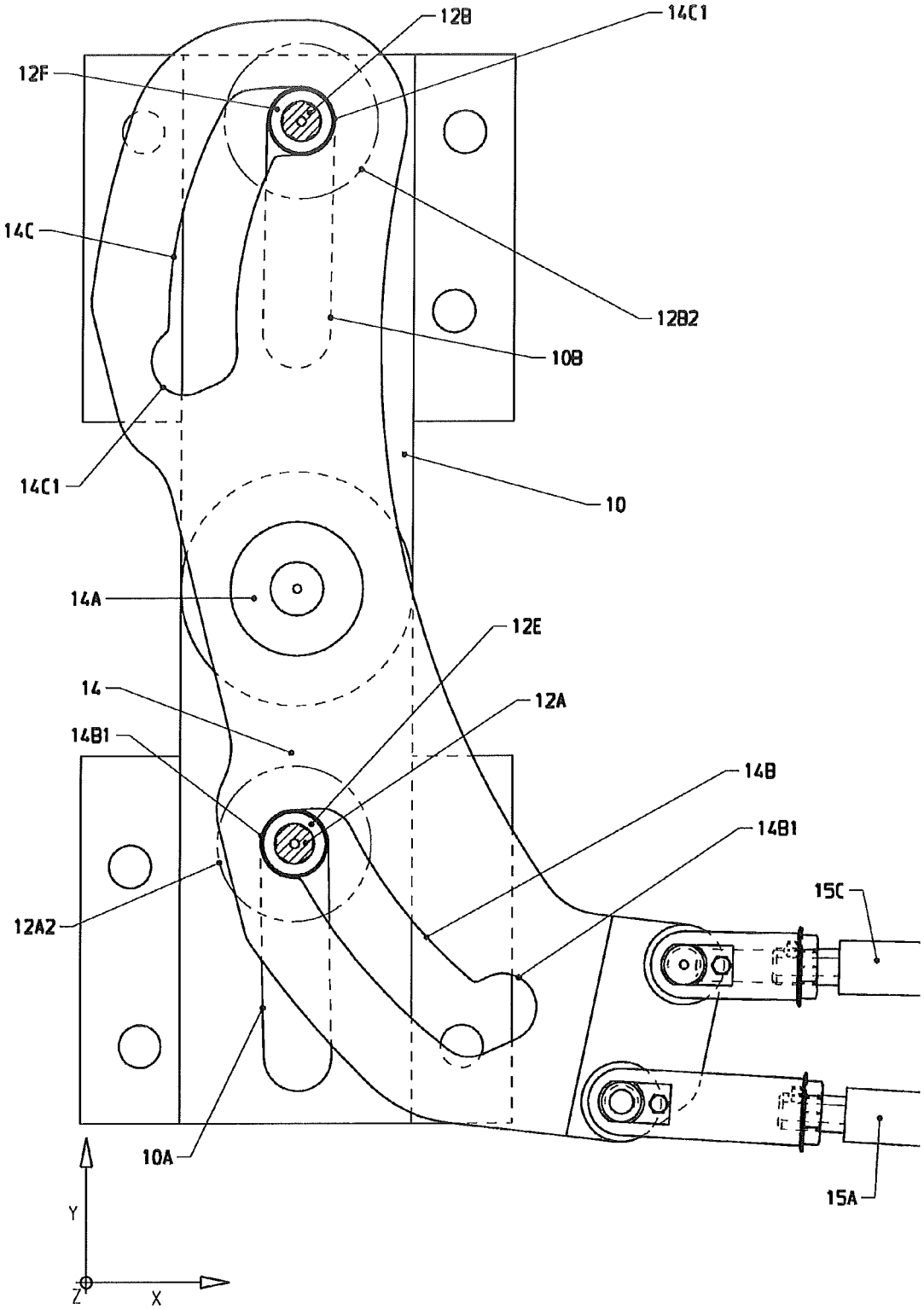
FIG. 11 shows a plan view like the one in FIG. 10 of the operating and locking mechanism at the entrance of the turnout in its end position corresponding to the diverted route.
Figure 12:
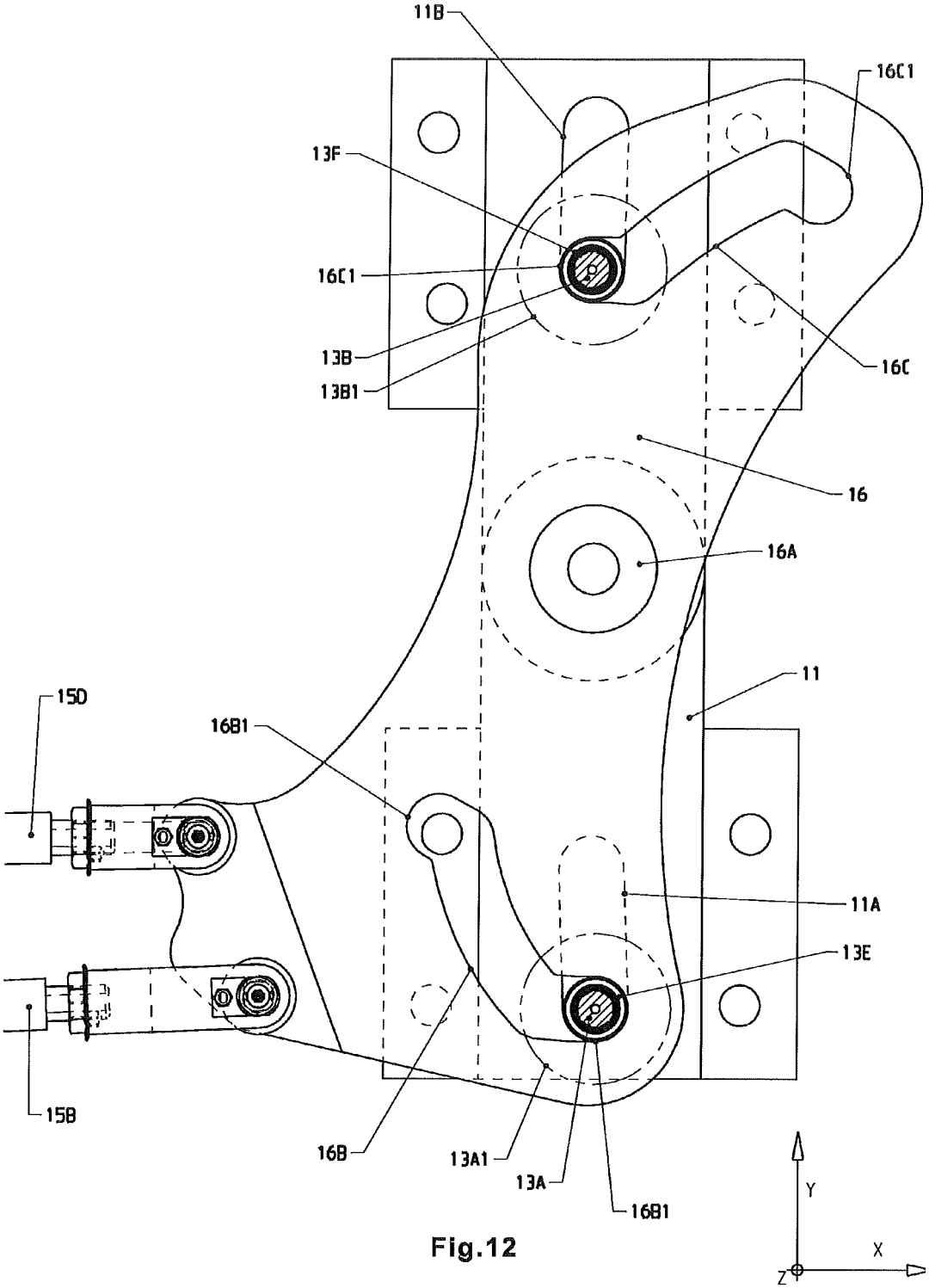
FIG. 12 shows a plan view of the operating and locking mechanism at the exit of the turnout in its end position corresponding to the main or direct route.
Figure 13:
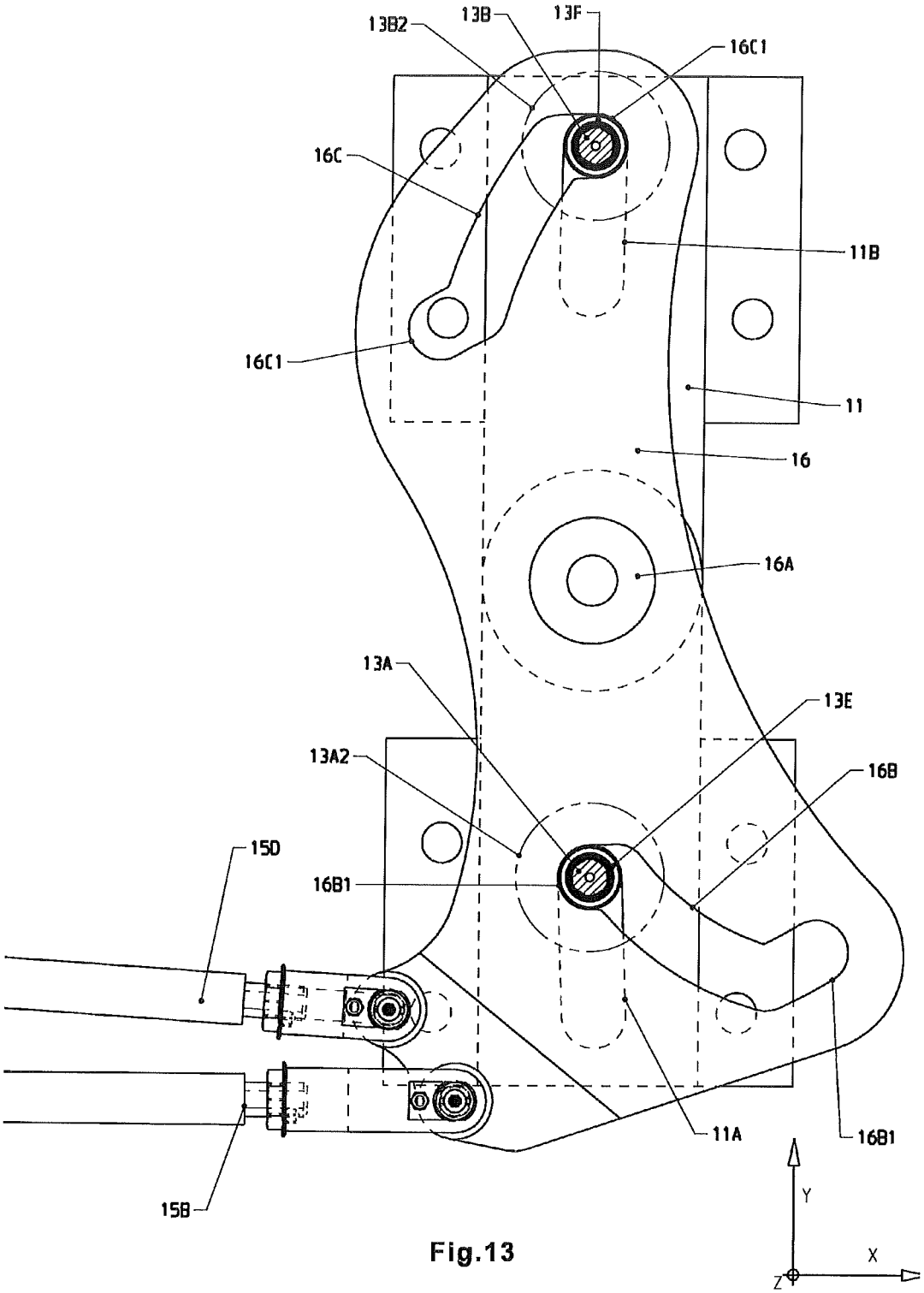
FIG. 13 shows a plan view like the one in FIG. 12 of the operating and locking mechanism at the exit of the turnout in its end position corresponding to the diverted route.

In turn, the mechanism comprises a moving panel or element (6) in turn comprising a guide rail of the main route (7) and a guide rail of the diverted route (8) which must be separated a minimum distance M, required for the passage of the guide wheels (9) of the vehicle, depicted in FIG. 3. The moving element (6) can pivot around a pivoting point (17) depicted in FIGS. 1 and 2, alternatively reaching the position of passage through the main route depicted in FIG. 1 or the position of passage through the diverted route depicted in FIG. 2. In both cases, continuous and safe routes are established for the pair of guide wheels (9) which are assembled in a common truck or bogie not depicted in FIG. 3 for the sake of clarity. The moving element (6) slides and is supported on a sliding plate (2A) of the fixed element (2). In order to prevent greasing, the sliding plate (2A) can optionally be equipped with, for example, Teflon or polyamide inserts (2B), on which the moving element (6) of the turnout slide or with antifriction coatings such as molybdenum or others.

The moving element (6) can be built by mechanical welding, based on guide profiles (7) and (8) of pearlite steel rail attached by welding or nuts and bolts to a structural steel base plate, or it is preferably in a monoblock configuration, i.e., cast and machined in a single part. This allows extraordinary design flexibility and the use of wear-resistant steels such as austenitic manganese steel or others.

It is contemplated that the moving element (6) comprises lugs (6A), preferably two at the entrance and two at the exit, in which shafts (12A, 12B, 13A, 13B) guiding the pivoting movement of the moving element (6) during the operation thereof are inserted. The moving element (6) is also equipped with lift prevention elements (6B) bolted along their length in their side areas. Said lift prevention elements (6B) have T-shaped bosses which are inserted in respective grooves (2D) made in the sliding plate (2A), fixing the upward vertical movement of the moving element (6) due to the actions of the guide wheels (9).

Given that the theoretical pivoting point (17) in the turnout depicted in FIGS. 1 and 2 is in the rear outbound part of the turnout, outside the turnout, it is necessary to generate rotation of the moving panel (6) around said virtual pivoting point (17) by means of the operating and locking mechanism of the present invention.

The mechanism comprises an inbound guide block (10) of the moving panel (6) and an outbound guide block (11) of said moving panel (6). Both guide blocks (10, 11) are fixed to the fixed part or casing (2) of the turnout by means of bolting or by means of welding and are made of wear-resistant steel.

In the inbound guide block (10) there are two guide grooves (10A, 10B) in the form of circular sectors, with radius of curvature R2, the center of said grooves (10A, 10B) being the theoretical pivoting point (17) of the moving panel (6) of the turnout.

In the outbound guide block (11) there are two guide grooves (11A, 11B) in the form of circular sectors, with radius of curvature R1, the center of said grooves (11A, 11B) being the theoretical pivoting point (17) of the moving panel (6) of the turnout.

The moving panel (6) has two shafts fixed thereto perpendicular to the sliding plane of said panel (12A, 12B) at the entrance, said shafts being made of high-strength steel, equipped with respective rollers (12C, 12D) which can move and roll within the guide grooves (10A, 10B) of the inbound guide block (10). The diameter of said rollers is slightly less than the width of the guide grooves to assure correct guiding. To make maintenance easier, said shafts have greasers in their upper part and conduits for greasing the bearings of the rollers (12C, 12D, 12E, 12F). Said rollers have sealed bearings and are preferably made from wear-resistant steel.

The moving panel (6) also has two shafts fixed thereto perpendicular to the sliding plane of said panel (13A, 13B) at the exit with respective rollers (13C, 13D) which can move and roll within the guide grooves (11A, 11B) of the outbound guide block (11). The diameter of said rollers is slightly less than the width of the guide grooves to assure correct guiding. To make maintenance easier, said shafts have greasers in their upper part and conduits for greasing the bearings of the rollers (13C, 13D, 13E, 13F). Said rollers have sealed bearings and are preferably made from wear-resistant steel.

Therefore, the moving panel (6) of the turnout can pivot around the theoretical pivoting point (17) being guided at the time of pivoting by the grooves of the previously described inbound guide block (10) and outbound guide block (11).

It is contemplated that the mechanism comprises an inbound moving rocking lever (14) pivoting around a shaft (14A) attached to the fixed element (2) of the turnout in its inbound area and with an outbound moving rocking lever (16) pivoting around a shaft (16A) attached to the fixed element (2) of the turnout in its outbound area. Both rocking levers (14, 16) are made of high-strength, wear-resistant steel. Their shafts have sealed bearings. The shafts (14A, 16A), made of high-strength steel, have greasers in their upper part in order to make maintenance of the bearings easier. Greasing and inspection of the shafts (14A, 16A) can be done by removing respectively covers (6G) and (6H) screwed to the moving element (6).

The shaft of the inbound moving rocking lever (14A) is centered in the inbound guide block (10) and perpendicular to the main plane thereof. The inbound moving rocking lever (14) is equipped with respective grooves (14B, 14C) in which the rollers (12E, 12F) attached respectively to the shafts (12A, 12B) of the moving panel (6) can be moved and rolled respectively. The diameter of said rollers is slightly less than the width of the grooves of the rocking lever to assure correct guiding. Said rollers are at a higher level Z than the rollers (12C, 12D) rotating respectively on said shafts (12A, 12B).

The shape of the grooves (14B, 14C) is such that when the moving rocking lever (14) pivots in one direction of rotation or another, these grooves are always oblique with respect to the grooves (10A, 10B) of the inbound guide block (10), such that the shafts (12A, 12B) and their respective rollers (12E, 12F) are driven by the moving rocking lever (14) and reach the end positions (12A1, 12B1) respectively corresponding to the alignment of the main route (7) of the moving panel (6) with the inbound rail (3) or alternatively reach the end positions (12A2, 12B2) corresponding to the alignment of the diverted route (8) of the moving panel (6) with the inbound rail (3). In the end positions (12A1, 12B1), the rollers (12C, 12D) respectively reach the end positions corresponding to a lower value of Y of the grooves (10A, 10B) of the inbound guide block (10). In the end positions (12A2, 12B2), the rollers (12C, 12D) respectively reach the end positions corresponding to a greater value of Y of the grooves (10A, 10B) of the inbound guide block (10).

The moving rocking lever (14) is moved by means of the drive motor (15) through alternating linear movement of the drive rod (15A). The secure end positions of the rocking lever (14) are checked by means of the detection rod (15C) attached to the drive motor. Both rods (15A, 15C) are made of structural steel and are equipped with lugs and pins in order to be attached in an articulated manner to the moving rocking lever (14). The pins have greasers in their upper part in order to make maintenance thereof easier.

The drive motor (15) is fixed to the casing (2) by means of bolted attachments, such that it does not experience relative movement with respect to said casing.

The grooves (14B, 14C) each have at their final ends two circular-shaped notches (14B1, 14C1) having a diameter slightly greater than the rollers (12E, 12F). When the inbound moving rocking lever (14) reaches its end positions, the rollers (12E, 12F) are fitted between the notches (14B1, 14C1) of the moving rocking lever (14), such that the shafts (12A, 12B) are mechanically trapped, and therefore the moving panel (6) is mechanically locked at the entrance in its end alignment position either for alignment of the inbound rail (3) with the rail of the main route (7) or alternatively for alignment of the inbound rail (3) with the rail of the diverted route (8).

In these end positions, and as a result of this mechanical locking system, spontaneous movement of the moving panel (6) due to external actions when the latter reaches its end positions is not possible.

The shaft of the outbound moving rocking lever (16A) is noticeably centered in the outbound guide block (11) and perpendicular to the main plane thereof. The outbound moving rocking lever (16) is equipped with respective grooves (16B, 16C) in which the rollers (13E, 13F) attached respectively to the shafts (13A) and (13B) of the moving panel (6) at the exit thereof can be moved and rolled respectively. The diameter of said rollers is slightly less than the width of the grooves of the rocking lever to assure correct guiding. Said rollers are at a higher level Z than the rollers (13C, 13D) rotating respectively on said shafts (13A, 13B).

The shape of the grooves (16B, 16C) is such that when the moving rocking lever (16) pivots in one direction of rotation or another, these grooves are always oblique with respect to the grooves (11A, 11B) of the outbound guide block (11), such that the shafts (13A, 13B) and their respective rollers (13E, 13F) are driven by the moving rocking lever (16) and the shafts (13A, 13B) and their respective rollers (13E, 13F) reach the end positions (13A1, 13B1) respectively corresponding to the alignment of the main route (7) of the moving panel (6) with the outbound rail (4) or alternatively reach the end positions (13A2, 13B2) corresponding to the alignment of the diverted route (8) of the moving panel (6) with the outbound guide rail (5). In the end positions (13A1) and (13B1), the rollers (13C) and (13D) respectively reach the end positions corresponding to a lower value of Y of the grooves (11A, 11B) of the outbound guide block (11). In the end positions (13A2, 13B2), the rollers (13C, 13D) respectively reach the end positions corresponding to a greater value of Y of the grooves (11A, 11B) of the outbound guide block (11).

The moving rocking lever (16) is moved by means of the drive motor (15) through alternating linear movement of the drive rod (15B). The secure end positions of the rocking lever (16) are checked by means of the detection rod (15D) attached to the drive motor. Both rods (15B, 15D) are made of structural steel and are equipped with lugs and pins in order to be attached in an articulated manner to the moving rocking lever (16). The pins have greasers in their upper part in order to make maintenance thereof easier.

The grooves (16B, 16C) each have at their final ends two circular-shaped notches (16B1, 16C1) having a diameter slightly greater than the rollers (13E, 13F). When the outbound moving rocking lever (16) reaches its end positions, the rollers (13E, 13F) are fitted between the notches (16B1, 16C1) of the moving rocking lever (16), such that the shafts (13A, 13B) are mechanically trapped, and therefore the moving panel (6) is mechanically locked at the exit in its end alignment position either for alignment of the outbound rail (4) with the main route (7) or alternatively for alignment of the outbound rail (5) with the diverted route (8).

In these end positions, and as a result of this mechanical locking system, spontaneous movement of the moving panel (6) due to external actions when the latter reaches its end positions is not possible.

The synchronous rotation and rotation in the same direction of both rocking levers (14, 16) thus causes the rotation of the moving panel or element (6) of the turnout around the pivoting point (17).

Therefore, in order to establish safe routes through both the direct route and the diverted route, the respective rocking levers (14, 16) at the entrance are moved in the same direction and the same movement by the drive rods (15A, 15B) of the drive motor (15) to the previously described end positions.

Figure 14:
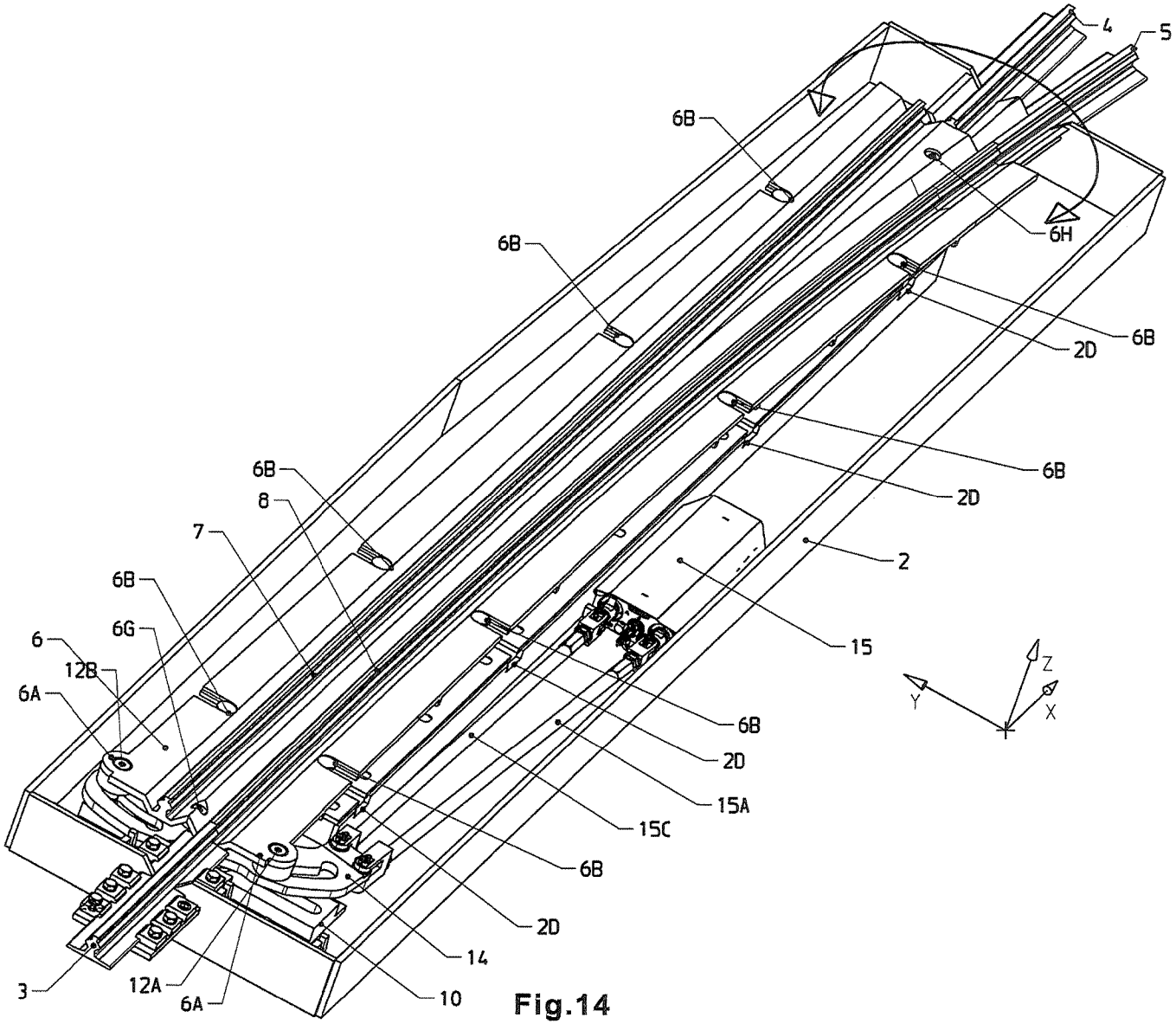
FIG. 14 shows a perspective view of an embodiment variant of the turnout of the invention, in this case depicted without the protective covers and its supports.
Figure 15:
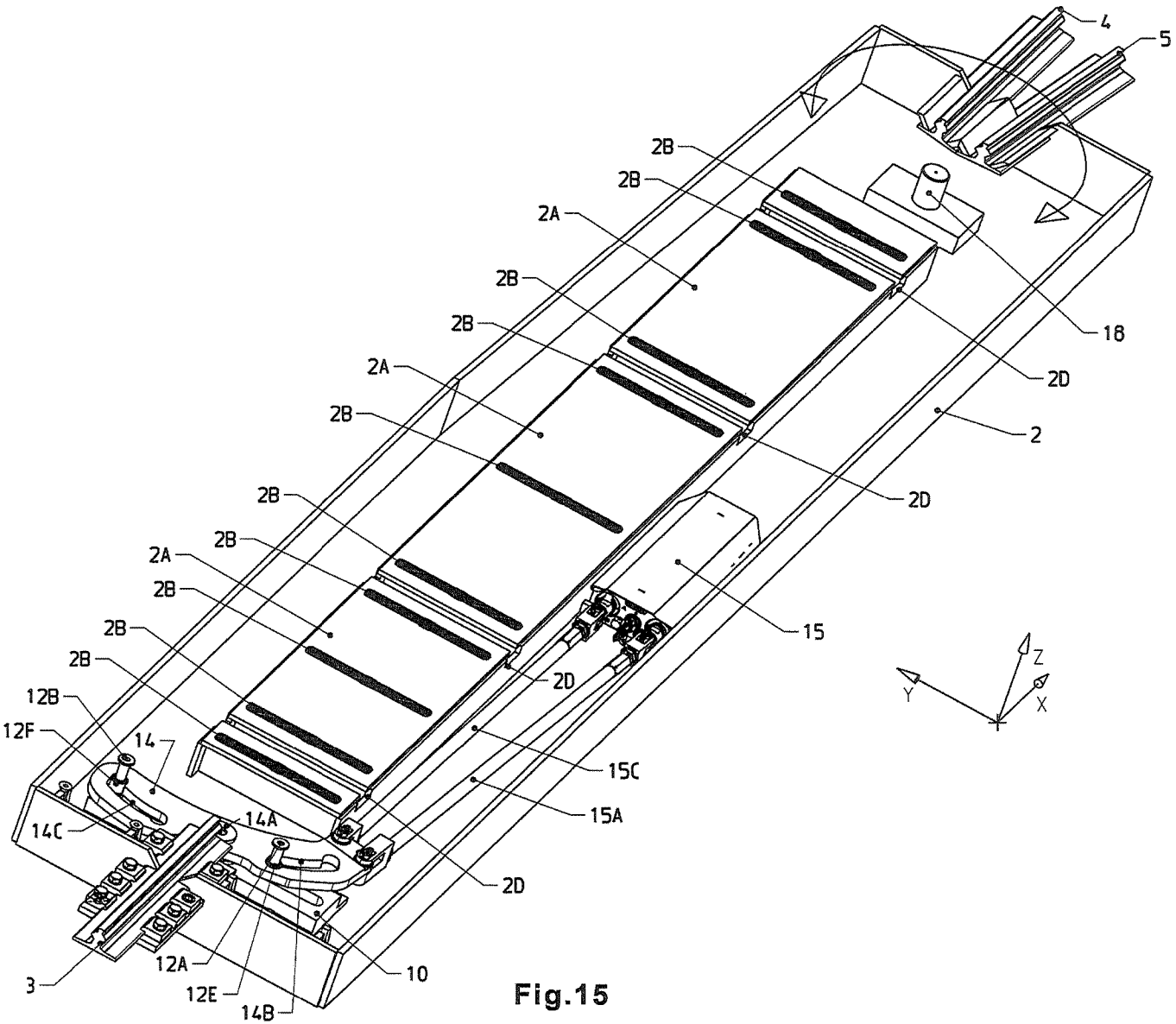
FIG. 15 shows a perspective view of the variant depicted in FIG. 14, in this case depicted without the protective covers, its supports and without the moving element.

FIGS. 14 and 15 show an embodiment variant of the mechanism of the invention in which the turnout comprises a fixed element (2) or casing and a moving element (6) which pivots around a pivoting shaft (18) located, see FIG. 15, within the turnout in the outbound area and in front of the guide rails (4, 5) and perpendicular to the main plane of the fixed element (2), being attached to it. In this configuration, the operating and locking mechanism assembly is needed only at the entrance of the turnout. The moving element (6) rotates around a real pivoting shaft (18), not a virtual one like in the preceding embodiment, located at the exit of the turnout, the guide rail of the main route (7) being able to be aligned with the inbound rail (3) and the outbound rail (4), or the guide rail of the diverted route (8) being able to be aligned with the inbound rail (3) and the outbound rail (5), therefore establishing vehicle traffic through the main route or the diverted route of the turnout, respectively.

In this embodiment variant, the operating and locking mechanism comprises the following elements having material qualities, features, operation and design that are the same as in the previously described preferred embodiment:

The inbound guide block (10) of the moving panel (6) is fixed to the fixed part (2) of the turnout by means of bolting or by means of welding.

In the inbound guide block (10) there are two guide grooves (10A, 10B) in the form of circular sectors, with radius of curvature R2, the center of said grooves (10A, 10B) being the pivoting shaft (18) of the moving panel (6) of the turnout.

The moving panel (6) has two shafts fixed thereto perpendicular to the sliding plane of said panel (12A, 12B) at the entrance with respective rollers (12C, 12D) which can move and roll within the guide grooves (10A, 10B) of the inbound guide block (10). The diameter of said rollers is slightly less than the width of the guide grooves to assure correct guiding.

The operating and locking mechanism in this alternative configuration is complemented with an inbound moving rocking lever (14) which pivots around the shaft (14A) attached to the fixed element or casing (2) of the turnout in its inbound area.

The shaft of the inbound moving rocking lever (14A) is centered in the inbound guide block (10) and perpendicular to the main plane thereof. The inbound moving rocking lever (14) is equipped with respective grooves (14B, 14C) in which the rollers (12E, 12F) attached respectively to the shafts (12A, 12B) of the moving panel (6) can be moved and rolled respectively. The diameter of said rollers is slightly less than the width of the grooves of the rocking lever to assure correct guiding. Said rollers are at a higher level Z than the rollers (12C, 12D) rotating respectively on said shafts (12A, 12B).

The shape of the grooves (14B, 14C) is such that when the moving rocking lever (14) pivots in one direction of rotation or another, these grooves are always oblique with respect to the grooves (10A, 10B) of the inbound guide block (10), such that the shafts (12A, 12B) and their respective rollers (12E, 12F) are driven by the moving rocking lever (14) and the shafts (12A, 12B) reach the end positions (12A1, 12B1) respectively corresponding to the alignment of the main route (7) of the moving panel (6) with the inbound rail (3) and outbound rail (4) or alternatively reach the end positions (12A2, 12B2) corresponding to the alignment of the diverted route (8) of the moving panel (6) with the inbound rail (3) and the outbound rail (5). In the end positions (12A1, 12B1), the rollers (12C, 12D) respectively reach the end positions corresponding to a lower value of Y of the grooves (10A, 10B) of the inbound guide block (10). In the end positions (12A2, 12B2), the rollers (12C, 12D) respectively reach the end positions corresponding to a greater value of Y of the grooves (10A, 10B) of the inbound guide block (10).

The moving rocking lever (14) is moved by means of the drive motor (15) through alternating linear movement of the drive rod (15A). The secure end positions of the rocking lever (14) are checked by means of the detection rod (15C) attached to the drive motor (15).

The drive motor (15) is fixed to the casing (2) by means of bolted attachments, such that it does not experience relative movement with respect to said casing.

The grooves (14B, 14C) each have at their final ends two circular-shaped notches (14B1, 14C1) having a diameter slightly greater than the rollers (12E, 12F). When the inbound moving rocking lever (14) reaches its end positions, the rollers (12E, 12F) are fitted between the notches (14B1, 14C1) of the moving rocking lever (14), such that the shafts (12A, 12B) are mechanically trapped, and therefore the moving panel (6) is mechanically locked at the entrance in its end alignment position either for alignment of the inbound rail (3) and outbound rail (4) with the main route (7) or alternatively for alignment of the inbound rail (3) and outbound rail (5) with the diverted route (8). In the end positions (12A1, 12B1), the rollers (12C, 12D) respectively reach the end positions corresponding to a lower value of Y of the grooves (10A, 10B) of the inbound guide block (10). In the end positions (12A2, 12B2), the rollers (12C, 12D) respectively reach the end positions corresponding to a greater value of Y of the grooves (10A, 10B) of the inbound guide block (10).

Having described the two preferred configurations of the operating and locking mechanism object of the present invention, the following advantages can be seen:

- The mechanism is compact and does not entail increasing the size of the turnout, likewise allowing compact integration of the drive motor, thus preventing the invasion of the area of the roadway intended for the rubber tires of guided vehicles. It allows for a very flat design of the fixed part of the turnout, given that not a lot of height is required for incorporating the mechanism.
- The mechanism is accessible from the upper part of the turnout by means of removing the protective covers (2C). The main elements of the mechanism can be inspected and accessed for cleaning and greasing.
- The mechanism has a mechanical locking functionality establishing safe routes through the direct route or the diverted route.
- The mechanism is compatible with various drive motors or manual lever boxes existing on the market.
- In the case of replacing elements that have broken down, the mechanism can be easily disassembled starting with the upper levels of the turnout.
- The life cycle cost of the mechanism is low since it uses wear-resistant elements and rollers that replace friction with rolling, said rollers and the shafts of the rocking levers having sealed bearings to reduce the need for greasing and maintenance.

The two configurations of the invention herein described are applied to single turnouts the main route of which is straight, though this is not a limiting factor since the operating and locking mechanism herein described can be applied to other types of turnouts, such as turnouts with a curved main track or turnouts in different directions right or left with respect to the diverted route.

In view of this description and set of drawings, the person skilled in the art will understand that the embodiments of the invention that have been described can be combined in many ways within the object of the invention. The invention has been described according to several preferred embodiments thereof, but for the person skilled in the art it will be obvious that multiple variations can be made to said preferred embodiments without exceeding the object of the claimed invention.

The invention claimed is:

1. An operating and locking mechanism for turnouts of central rail-guided vehicles, a turnout comprising:

a fixed part;

a moving panel having a guide rail of a main route and a guide rail of a diverted route;

an inbound rail for the main route attached to the fixed part and an outbound guide rail for the main route attached to the fixed part, an outbound guide rail for the diverted route attached to the fixed part, such that the moving panel is configured to pivot with respect to a pivoting point located outside the turnout on the outbound side, such that the moving panel alternatively allows passage through the main route or through the diverted route when, respectively, the guide rail of the main route is aligned with the inbound rail and the outbound rail, or when the guide rail of the diverted route is aligned with the inbound rail and the outbound guide rail, wherein the mechanism disposed at an entrance of the turnout comprises:

a first guide block fixed to the fixed part comprising two first guide grooves in the form of circular sectors located on the main plane of the first guide block, the center of said first guide grooves coincides with the pivoting point and both have the same radius of curvature, first and second shafts fixed to the moving panel in its inbound area and perpendicular to the main plane of the moving panel, with first and second rollers configured to be moved and rolled respectively within the first guide grooves, the diameter of said first and second rollers being less than the width of the first guide grooves, a first rocking lever configured to pivot around a shaft attached to the fixed part, and centered with respect to the first guide block and perpendicular to the main plane thereof, wherein said first rocking lever comprises at least two first rocker grooves located on the main plane of the first rocking lever within which third and fourth rollers are attached and rotate respectively on said first and second shafts and are configured to be moved and rolled, said third and fourth rollers being at a higher level Z with respect to said first and second rollers of said first and second shafts, the diameter of the third and fourth rollers being less than the width of the at least two first rocker grooves;

where the mechanism disposed at the exit of the turnout comprises:

a second guide block fixed to the fixed part comprising two second guide grooves formed as circular sectors located on the main plane of the second guide block, the center of said second guide grooves coincides with the pivoting point and both have the same radius of curvature, third and fourth shafts fixed to the moving panel in its outbound area and perpendicular to the main plane of the moving panel, with fifth and sixth rollers configured to be moved and rolled respectively within the second guide grooves, the diameter of said fifth and sixth rollers being less than the width of the second guide grooves, a second rocking lever pivots around a shaft attached to the fixed part, and centered with respect to the second guide block and perpendicular to the main plane thereof, wherein said second rocking lever comprises at least two second rocker grooves located on the main plane of the second rocking lever within which seventh and eighth rollers are attached and rotate respectively on said third and fourth shafts and are configured to be moved and rolled, said seventh and eighth rollers being at a higher level Z with respect to said fifth and sixth rollers of said third and fourth shafts, the diameter of the seventh and eighth rollers being less than the width of the at least two second rocker grooves, where the first and second rocking levers move in a synchronous manner and in the same direction by means of at least two rods of a drive motor, generating a rotation of the moving panel around the pivoting point such that said first, second, third, and fourth shafts simultaneously reach their locking positions, corresponding to the traffic through either the main route or the diverted route.

2. The mechanism according to claim 1, wherein in the first rocking lever:

the two first rocker grooves are shaped such that when the first rocking lever pivots in one direction of rotation or another, the two first rocker grooves are always oblique with respect to the first guide grooves of the first guide block, such that the first and second shafts and their third and fourth rollers are driven by the first rocking lever and the first and second shafts respectively reach first and second end positions, the first and second rollers simultaneously reaching at least one of the first or second end position corresponding to a lower value of Y of the first guide grooves of the first guide block corresponding to the alignment of the guide rail of the main route of the moving panel with the inbound rail, or alternatively the first and second shafts reach the third and fourth end positions, the first and second rollers simultaneously reaching at least one of the third or fourth end position corresponding to a greater value of Y of the first guide grooves of the first guide block corresponding to the alignment of the diverted route of the moving panel with the inbound rail, the at least two first rocker grooves have at their final ends two semicircular-shaped notches having a diameter slightly greater than the third and fourth rollers, such that when the third and fourth rollers reach their extreme end positions in the at least two first rocker grooves respectively the third and fourth rollers are mechanically fitted in the two semicircular-shaped notches respectively, the moving panel therefore being mechanically locked in a secure manner in a first alignment position for alignment of the inbound rail with the guide rail of the main route, or in a second alignment position for alignment of the inbound rail with the guide rail of the diverted route, where the first rocking lever is moved by the drive motor through linear movement in one direction or the other of a first drive rod.

3. The mechanism according to claim 1, wherein in the second rocking lever of the exit of the turnout:

the two second rocker grooves are shaped such that when the second rocking lever pivots in one direction of rotation or another, these grooves are always oblique with respect to the second guide grooves of the second guide block, such that the third and fourth shafts and their respective seventh and eighth rollers are driven by the second rocking lever and the third and fourth shafts respectively reach the fifth and sixth end positions, the fifth and sixth rollers simultaneously reaching the end position corresponding to a lower value of Y of the second guide grooves of the second guide block corresponding to the alignment of the guide rail of the main route of the moving panel with the outbound rail, or alternatively the third and fourth shafts reach the seventh and eighth end positions, the fifth and sixth rollers simultaneously reaching at least one of the seventh or eighth end position corresponding to a greater value of Y of the second guide grooves of the second guide block corresponding to the alignment of the guide rail of the diverted route of the moving panel with the outbound guide rail, the at least two second rocker grooves respectively have at their final ends two semicircular-shaped notches having a diameter slightly greater than the seventh and eighth rollers, such that when the seventh and eighth rollers reach their extreme end positions in the at least two second rocker grooves respectively the seventh and eighth rollers are mechanically fitted in the two semicircular-shaped notches respectively, the moving panel being mechanically locked and secured such that in a third alignment position for alignment of the outbound rail with the guide rail of the main route, or in a fourth alignment position for alignment of the outbound guide rail with the guide rail of the diverted route, where the second rocking lever is moved by the drive motor through linear movement in one direction or the other of a second drive rod.

4. An operating and locking mechanism for turnouts of central rail-guided vehicles, a turnout comprising:

a fixed part, a moving panel having a guide rails of a main route and a guide rail of a diverted route, an inbound rail for the main route attached to the fixed part and an outbound guide rail for the main route attached to the fixed part, an outbound guide rail for the diverted route attached to the fixed part, such that the moving panel is configured to pivots around a shaft perpendicular to the main plane of the fixed part located within the turnout on the outbound side, such that the moving panel alternatively allows passage through the main route or through the diverted route, when, respectively, the guide rail of the main route is aligned with the inbound rail and the outbound rail, or when the guide rail of the diverted route is aligned with the inbound rail and the outbound guide rail, wherein the mechanism disposed at the entrance of the turnout comprises:

a first guide block fixed to the fixed part of the turnout equipped with two first guide grooves formed as circular sectors located on the main plane of the first guide block, the center of said first groove guides coincides with the shaft of the moving panel and both have the same radius of curvature, first and second shafts fixed to the moving panel in its inbound area and perpendicular to the main plane of the moving panel, with first and second rollers configured to be moved and rolled respectively within the first guide grooves, the diameter of said first and second rollers being less than the width of the first guide grooves, a first rocking lever configured to pivots around a shaft attached to the fixed part, and centered with respect to the first guide block and perpendicular to the main plane thereof, wherein said rocking lever comprises at least two first rocker grooves located on the main plane of the first rocking lever within which third and fourth rollers are attached and rotate respectively on said first and second shafts are configured to be moved and rolled, said third and fourth rollers being at a higher level Z with respect to said first and second rollers, the diameter of the third and fourth rollers being less than the width of the at least two first rocker grooves, said rocking lever wherein:

the two first rocker grooves are shaped such that when the first rocking lever pivots in one direction of rotation or another, the first guide grooves are always oblique with respect to the first guide grooves of the first guide block, such that the first and second shafts and their third and fourth rollers are driven by the first rocking lever and the first and second shafts respectively reach first and second end positions, the first and second rollers simultaneously reaching at least one of the first and second end position corresponding to a lower value of Y of the first guide grooves of the first guide block corresponding to the alignment of the guide rail of the main route of the moving panel with the inbound rail and the outbound rail, or alternatively the first and second shafts reach the third and fourth end positions, the first and second rollers simultaneously reaching at least one of the third or fourth end position corresponding to a greater value of Y of the first guide grooves and of the first guide block corresponding to the alignment of the guide rail of the diverted route of the moving panel with the inbound rail and the outbound guide rail, the at least two first rocker grooves have at their final ends two semicircular-shaped notches having a diameter slightly greater than the third and fourth rollers, such that when the third and fourth rollers reach their extreme end positions in the at least two first rocker grooves respectively the third and fourth rollers are mechanically fitted in the two semicircular-shaped notches respectively, the moving panel therefore being mechanically locked in a secure manner such that the shafts reach their locking positions, corresponding to traffic through either the main route or the diverted route, wherein the first rocking lever is moved by the drive motor through linear movement in one direction or the other of a drive rod.

* * * * *